US009445645B2

(12) United States Patent
Auger et al.

(10) Patent No.: US 9,445,645 B2
(45) Date of Patent: Sep. 20, 2016

(54) SOLE MEMBER FOR AN ARTICLE OF FOOTWEAR

(71) Applicant: NIKE, Inc., Beaverton, OR (US)

(72) Inventors: Perry W. Auger, Tigard, OR (US); Andrew Caine, Portland, OR (US); Sergio Cavaliere, Venezia (IT)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/813,981

(22) Filed: Jul. 30, 2015

(65) Prior Publication Data

US 2016/0007677 A1 Jan. 14, 2016

Related U.S. Application Data

(62) Division of application No. 13/311,070, filed on Dec. 5, 2011, now Pat. No. 9,119,438.

(51) Int. Cl.

| | |
|---|---|
| ***A43B 13/12*** | (2006.01) |
| ***A43B 13/22*** | (2006.01) |
| ***A43B 13/26*** | (2006.01) |
| ***A43B 1/00*** | (2006.01) |
| ***A43B 7/14*** | (2006.01) |
| ***A43B 13/02*** | (2006.01) |

(Continued)

(52) U.S. Cl.

CPC ..... *A43B 13/12* (2013.01); *A43B 1/0009* (2013.01); *A43B 5/02* (2013.01); *A43B 7/141* (2013.01); *A43B 7/142* (2013.01); *A43B 7/143* (2013.01); *A43B 7/144* (2013.01); *A43B 7/1425* (2013.01); *A43B 7/1435* (2013.01); *A43B 13/026* (2013.01); *A43B 13/223* (2013.01); *A43B 13/26* (2013.01); *A43B 23/222* (2013.01)

(58) Field of Classification Search

CPC .. A43B 23/222; A43B 23/22; A43B 23/225; A43B 23/227; A43B 1/0009; A43B 13/026; A43B 13/12; A43B 13/26; A43B 13/223

USPC ..... 36/107, 108, 76 R, 30 R

See application file for complete search history.

(56) References Cited

U.S. PATENT DOCUMENTS

| | | | |
|---|---|---|---|
| 3,341,952 | A | 9/1967 | Dassler |
| 4,096,649 | A | 6/1978 | Saurwein |
| 4,454,662 | A | 6/1984 | Stubblefield |

(Continued)

FOREIGN PATENT DOCUMENTS

| | | | |
|---|---|---|---|
| CN | 104159465 | A | 11/2014 |
| EP | 2787854 | A1 | 10/2014 |

(Continued)

OTHER PUBLICATIONS

Chinese Office Action mailed Jul. 6, 2015 for Chinese Application No. 201280059629.2.

(Continued)

*Primary Examiner* — Ted Kavanaugh

(74) *Attorney, Agent, or Firm* — Plumsea Law Group, LLC

(57) ABSTRACT

A sole member for an article of footwear includes a composite sole structure and a reinforcing member. The sole structure may comprise two layers of woven composite material. The two layers have substantially similar woven patterns. The sole structure includes bulging portions with centrally recessed portions. The reinforcing member fits into channels associated with the bulging portions.

20 Claims, 15 Drawing Sheets

(51) Int. Cl.
*A43B 5/02* (2006.01)
*A43B 23/22* (2006.01)

(56) References Cited

U.S. PATENT DOCUMENTS

| | | | | |
|---|---|---|---|---|
| 5,185,943 | A * | 2/1993 | Tong | A43B 13/184 36/27 |
| 5,452,526 | A | 9/1995 | Collins | |
| 5,461,801 | A | 10/1995 | Anderton | |
| 5,545,463 | A | 8/1996 | Schmidt et al. | |
| 5,679,439 | A | 10/1997 | Schmidt et al. | |
| 6,694,642 | B2 * | 2/2004 | Turner | A43B 13/143 36/28 |
| 7,181,868 | B2 | 2/2007 | Auger et al. | |
| RE40,474 | E | 9/2008 | Quellais et al. | |
| 7,437,838 | B2 | 10/2008 | Nau | |
| 7,533,477 | B2 | 5/2009 | Goodwin et al. | |
| 7,832,117 | B2 * | 11/2010 | Auger | B29D 35/142 36/103 |
| 8,201,346 | B2 * | 6/2012 | Darby, II | A43B 7/00 36/100 |
| 9,119,438 | B2 | 9/2015 | Auger et al. | |
| 2002/0178619 | A1 | 12/2002 | Schaudt et al. | |
| 2003/0172548 | A1 | 9/2003 | Fuerst | |
| 2004/0154192 | A1 | 8/2004 | Bengtsson et al. | |
| 2007/0107267 | A1 | 5/2007 | Hodgson | |
| 2009/0320330 | A1 | 12/2009 | Borel et al. | |
| 2010/0251565 | A1 | 10/2010 | Litchfield et al. | |
| 2011/0088287 | A1 | 4/2011 | Auger et al. | |
| 2011/0107622 | A1 | 5/2011 | Schwirian | |
| 2011/0289801 | A1 | 12/2011 | Amos et al. | |
| 2013/0067765 | A1 * | 3/2013 | Auger | A43B 5/02 36/31 |
| 2013/0139412 | A1 | 6/2013 | Auger et al. | |
| 2014/0338230 | A1 * | 11/2014 | Auger | A43B 5/02 36/30 R |

FOREIGN PATENT DOCUMENTS

| | | |
|---|---|---|
| FR | 2794005 A1 | 12/2000 |
| FR | 2914156 A1 | 10/2008 |
| GB | 2256784 A | 12/1992 |

OTHER PUBLICATIONS

International Search Report and Written Opinion for Application No. PCT/US2012/066315, mailed Mar. 12, 2013.

International Preliminary Report on Patentability (including Written Opinion of the ISA) mailed Jun. 19, 2014 in International Application No. PCT/US2012/066315.

* cited by examiner

SOLE MEMBER FOR AN ARTICLE OF FOOTWEAR

CROSS REFERENCE TO RELATED APPLICATION

This non-provisional U.S. Patent Application is a divisional of and claims priority under 35 U.S.C. 121 to U.S. application Ser. No. 13/311,070 entitled "Sole Member For An Article Of Footwear," filed on Dec. 5, 2011, which published as U.S. Patent Application Publication Number US 2013/0139412 on Jun. 6, 2013 and was allowed on Apr. 29, 2015, the disclosure of which application is hereby incorporated by reference in its entirety.

BACKGROUND

The present embodiments relate generally to articles of footwear, and in particular to a sole member for an article of footwear.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

SUMMARY

In one aspect, a sole structure for an article of footwear includes a base portion and a bulging portion extending distally from the base portion. The bulging portion comprises a peripheral portion and a central portion bounded by the peripheral portion. The central portion is recessed with respect to the peripheral portion.

In another aspect, a sole structure for an article of footwear includes a forefoot portion, a midfoot portion and a heel portion. The sole structure also includes a base portion extending through the forefoot portion, the midfoot portion and the heel portion. The sole structure also includes a first bulging portion extending distally from the base portion, where the first bulging portion is disposed in the forefoot portion and the midfoot portion. The sole structure also includes a second bulging portion extending distally from the base portion, where the second bulging portion is disposed in the heel portion. The first bulging portion includes a first peripheral portion and a first central portion. The second bulging portion includes a second peripheral portion and a second central portion. The first central portion is recessed with respect to the first peripheral portion and the second central portion is recessed with respect to the second peripheral portion.

In another aspect, a sole member for an article of footwear includes a sole structure with a first side and a second side; a base portion and a bulging portion extending distally from the first side of the base portion. The bulging portion includes a peripheral portion and a central portion bounded by the peripheral portion. The central portion is recessed with respect to the peripheral portion. The sole member also includes a reinforcing member disposed against the second side of the base portion in a region corresponding to the bulging portion. The reinforcing member includes a cut-out portion that is configured to receive the central portion of the bulging portion.

In another aspect, a sole structure for an article of footwear includes a base portion and a bulging portion extending distally from the base portion. The bulging portion further includes at least one tapering portion extending along an outer peripheral edge of the sole structure. The at least one tapering portion including a first end portion and a second end portion. The height of the at least one tapering portion decreases substantially gradually from the first end portion to the second end portion and the width of the at least one tapering portion decreases substantially gradually from the first end portion to the second end portion.

In another aspect, a sole structure for an article of footwear includes a first composite layer with a first base portion and a first bulging portion. The sole structure also includes a second composite layer with a second base portion and a second bulging portion, where the second bulging portion corresponds to the first bulging portion. The first composite layer is a first woven layer with a first weave orientation. The second composite layer is a second woven layer with a second weave orientation. The first weave orientation is substantially equal to the second weave orientation.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
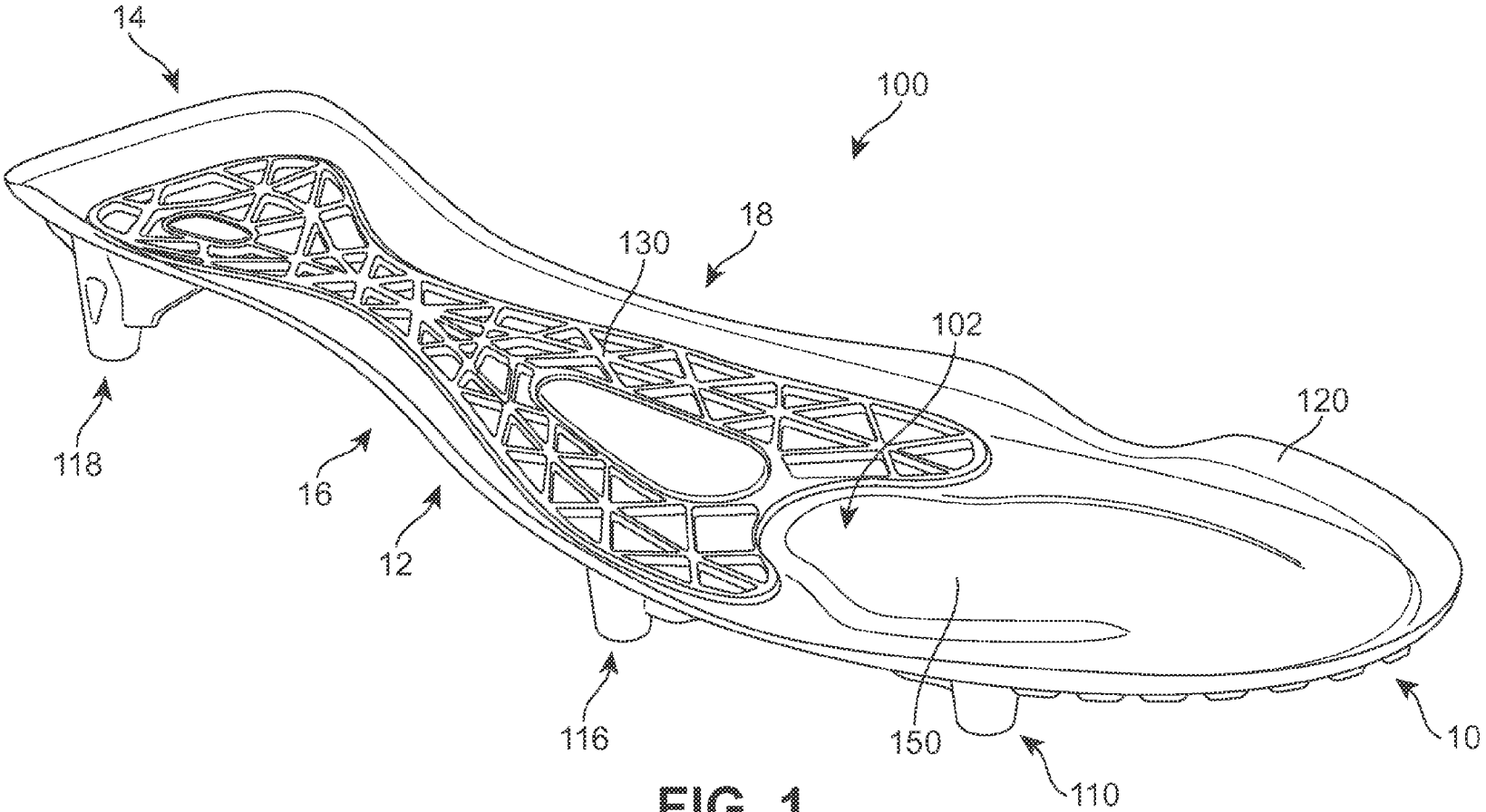
FIG. 1 is an isometric view of an embodiment of a proximal side of a sole member.
Figure 2:
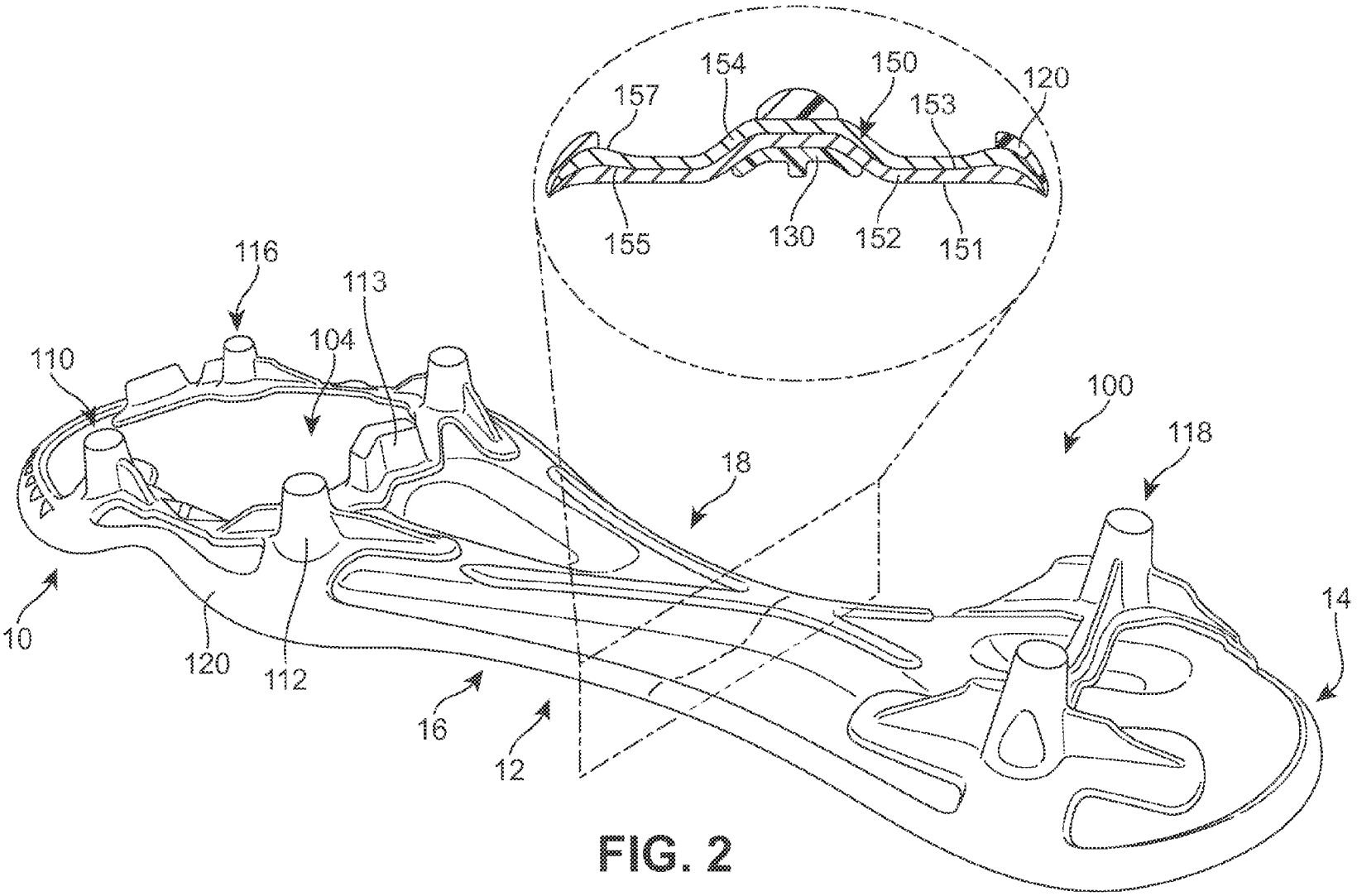
FIG. 2 is an isometric view of an embodiment of a distal side of a sole member.

FIGS. 1 and 2 illustrate isometric views of an embodiment of sole member 100 that may be incorporated into an article of footwear. Sole member 100 could be incorporated into any type of footwear including, but not limited to: hiking boots, soccer shoes, football shoes, sneakers, rugby shoes, basketball shoes, baseball shoes as well as other kinds of shoes. As shown in FIGS. 1 and 2, sole member 100 is intended to be used with a right foot; however, it should be understood that the following discussion may equally apply to a mirror image of sole member 100 that is intended for use with a left foot.

Generally, sole member 100 may comprise one or more components traditionally associated with the sole of an article. For example, in some cases, sole member 100 may comprise an insole. In other cases, sole member 100 may comprise a midsole. In still other cases, sole member 100 may comprise an outsole. In still other cases, sole member 100 could comprise any combination of components, including, for example, a midsole and an outsole. In some embodiments, sole member 100 may comprise a soccer plate.

In some embodiments, sole member 100 may be configured to provide traction for article 100. In addition to providing traction, sole member 100 may attenuate ground reaction forces when compressed between the foot and the ground during walking, running or other ambulatory activities. The configuration of sole member 100 may vary significantly in different embodiments to include a variety of conventional or non-conventional structures. In some cases, the configuration of sole member 100 can be configured according to one or more types of ground surfaces on which sole member 100 may be used. Examples of ground surfaces include, but are not limited to: natural turf, synthetic turf, dirt, as well as other surfaces.

For purposes of reference, sole member 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole member 100 may include lateral side 16 and medial side 18. In particular, lateral side 16 and medial side 18 may be opposing sides of sole member 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole member 100. Likewise, lateral side 16 and medial side 18 are intended to represent generally two sides of sole member 100, rather than precisely demarcating sole member 100 into two halves.

For consistency and convenience, directional adjectives are employed throughout this detailed description corresponding to the illustrated embodiments. The term "longitudinal" as used throughout this detailed description and in the claims refers to a direction extending a length of a footwear component. In some cases, the longitudinal direction may extend from a forefoot portion to a heel portion of the footwear component. Also, the term "lateral" as used throughout this detailed description and in the claims refers to a direction extending a width of the footwear component. In other words, the lateral direction may extend between a medial side and a lateral side of the footwear component. Furthermore, the term "vertical" as used throughout this detailed description and in the claims refers to a direction generally perpendicular to a lateral and longitudinal direction. For example, in cases where a sole member is planted flat on a ground surface, the vertical direction may extend from the ground surface upward. In addition, the term "proximal" refers to a direction that is directed towards a center of a footwear component. Likewise, the term "distal" refers to a direction that is directed away from a center of the footwear component.

Sole member 100 may include a first side 102 and a second side 104. In some cases, first side 102 may be an inner or upper side. In particular, first side 102 may confront a foot or a component of an upper. In some cases, second side 104 may be an outer or lower side of sole member 100. In particular, second side 104 may be configured to contact a ground surface.

In some embodiments, sole member 100 can comprise multiple different components. In some cases, sole member 100 includes sole structure 150. Sole structure 150 may comprise a substantially rigid structure that provides strength and support for sole member 100. In some cases, sole structure 150 may extend the full length of sole member 100. In other cases, however, sole structure 150 could extend through only a portion of sole member 100.

In some embodiments, sole structure 150 may be a layered structure. Generally, sole structure 150 may comprise any number of layers. In some cases, sole structure 150 can comprise two or more layers. In other cases, sole structure 150 can comprise three layers. In one embodiment, sole structure 150 comprises two layers including first layer 152 and second layer 154. In still other embodiments, however, sole structure 150 may include a single layer.

First layer 152 may include first side 151 and second side 153. In addition, second layer 154 may include first side 155 and second side 157. In some cases, second side 153 of first layer 152 may confront first side 155 of second layer 154. In other words, first layer 152 may be stacked against second layer 154.

In some embodiments, sole member 100 may also include reinforcing member 130 (see FIG. 1). In some embodiments, reinforcing member 130 may comprise a substantially rigid member that is configured to increase stability for sole member 100. Moreover, the size, shape and rigidity of reinforcing member 130 may be varied in different embodiments to achieve a desired degree of additional support for sole member 100. Further details of reinforcing member 130 are discussed below with reference to FIGS. 6 and 7.

In some embodiments, sole member 100 may also include outer member 120. In some cases, sole structure 150 may be disposed within outer member 120. For example, in one embodiment, outer member 120 may comprise a material this is molded over sole structure 150 as well as reinforcing member 130. In some cases, outer member 120 may encase sole structure 150. In other cases, however, outer member 120 may cover only sole portions of sole structure 150. Also, in some cases, outer member 120 may not cover reinforcing member 130. In one embodiment, outer member 120 is disposed on some portions of sole structure 150, but not others. For example, outer member 120 may cover peripheral edges of sole structure 150. With this arrangement, outer member 120 may provide a protective covering for some portions of support structure 150. In addition, in some cases, outer member 120 may provide a means for attaching additional components to sole member 100.

In some embodiments, sole member 100 may include provisions for enhancing traction with a ground surface. For example, in some cases, sole member 100 can include one or more cleat members. Cleat members may be configured to penetrate into a ground surface. In one embodiment, sole member 100 includes plurality of cleat members 110. In some cases, plurality of cleat members 110 may be disposed on second side 104 of sole member 100. Plurality of cleat members 110 may further comprise forefoot cleat members 116 and heel cleat members 118.

In some embodiments, plurality of cleat members 110 may be integrally formed with outer member 120. For example, in an embodiment where outer member 120 is molded over sole structure 150, plurality of cleat members 110 may be formed simultaneously with outer member 120. In other embodiments, however, plurality of cleat members 110 may not be integrally formed with outer member 120. For example, in another embodiment, plurality of cleat members 110 could be detachable cleat members that fasten to outer member 120.

In different embodiments, the number of cleat members comprising plurality of cleat members 110 could vary. In the current embodiment, forefoot cleat members 116 comprise five cleat members while heel cleat members 118 comprise two cleat members. In other cases, however, forefoot cleat members 116 could have more than five cleat members. In still other cases, forefoot cleat members 116 could have less than five cleat members. Likewise, in other cases, heel cleat members 118 could have more than two cleat members. In still other cases, heel cleat members 118 could have less than two cleat members.

In different embodiments, the geometry of each cleat member in plurality of cleat members 110 could vary. For example, some embodiments may include cylindrical cleat members. Other embodiments may include tapered cylindrical (or frustum conical) cleat members. Still other embodiments may include rectangular cleat members. Moreover, any other shapes for cleat members may be possible in other embodiments. In one embodiment, plurality of cleat members 110 comprises six tapered conical cleat members 112 and a single rectangular cleat member 113 (see FIG. 2).

The general arrangement of cleat members on sole member 100 may vary. In some cases, the locations of one or more cleat members may be selected to correspond with one or more geometric features of sole member 100. For example, in some cases, one or more cleat members may be disposed on highly contoured portions of sole member 100.

The materials of one or more components of sole member 100 could vary in different embodiments. Generally, materials for each component may be selected to achieve desired material properties including, but not limited to: strength, durability, flexibility, rigidity, weight as well as other material properties. As one example, materials for sole structure 150 could be selected to achieve a substantially rigid component that is lightweight and durable.

Generally, first layer 152 and second layer 154 of sole structure 150 could be made of any materials. In some cases, first layer 152 and second layer 154 may each comprise a layer of composite material. Examples of composite materials include, but are not limited to: fiber-reinforced composite materials (including short fiber-reinforced materials and continuous fiber-reinforced materials), fiber-reinforced polymers (including carbon-fiber reinforced plastic and glass-reinforced plastic), carbon nanotube reinforced polymers, as well as any other kind of composite materials known in the art. In one embodiment, first layer 152 and second layer 154 may be made of carbon fiber-reinforced plastic. It will also be understood that in other embodiments, first layer 152 and second layer 154 could be made of substantially different materials.

Generally, outer member 120 may comprise any materials. Examples of different materials that may be used for constructing outer member 120 include, but are not limited to: polymers, plastics, thermoplastics, foams, rubbers, as well as any other kinds of materials. In one embodiment, outer member 120 may be made of thermoplastic polyurethane (TPU). Moreover, in some cases, outer member 120 may be made of a material that is substantially transparent so that portions of sole structure 150 may be partially visible through outer member 120.

In different embodiments, reinforcing member 130 may be made of various kinds of materials. Examples of different kinds of materials that may be used include, but are not limited to: metals, polymers, plastics, thermoplastics, foams, rubbers, composite materials, as well as any other kinds of materials. In one embodiment, reinforcing member 130 may comprise a substantially rigid plastic.

For purposes of clarity, many of the following Figures illustrate views of sole member 100 with outer member 120 removed. The principles discussed below for a sole structure may apply to embodiments in which an outer member is present as well as embodiments in which no outer member is present.

Throughout the following, sole structure 150 may be described with reference to a first side and a second side. In embodiments in which sole structure 150 comprises multiple layers, the first side and the second side may refer to the outermost layers that are exposed. For example, in the current embodiment, sole structure 150 may include proximal side 156 (see FIGS. 6 and 7) and distal side 158 (see FIGS. 3 and 4). Proximal side 156 may be a side of sole structure 150 that is configured to confront a foot or portion of an upper. Moreover, proximal side 156 may correspond to first side 151 of first layer 152. Distal side 158 may be a side of sole structure 150 that is configured to face towards a ground surface during use. Moreover, distal side 158 may correspond to second side 157 of second layer 154.

For purposes of describing the geometry of sole structure 150, the term depth may be used. The term "depth" as used throughout this detailed description and in the claims refers to the approximate distance between a portion of sole structure 150 a reference point (or surface) having a relatively fixed vertical position. For example, in some cases, the depth may refer to the approximate distance between a portion of sole structure 150 and a plane coincident with an outer peripheral edge of sole structure 150. In other cases, the depth could be measured as the approximate vertical distance between two adjacent portions. In some cases, the depth of sole structure 150 may vary over different regions.

Figure 3:
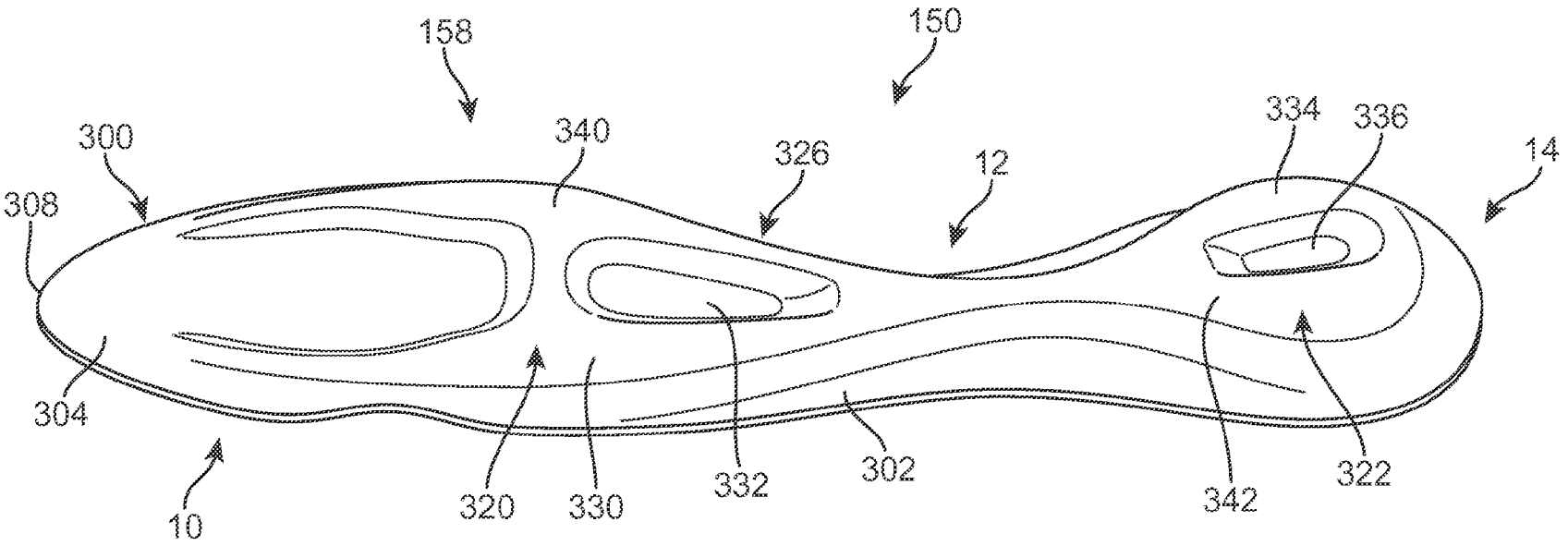
FIG. 3 is a side perspective view of an embodiment of a distal side a sole structure.
Figure 4:
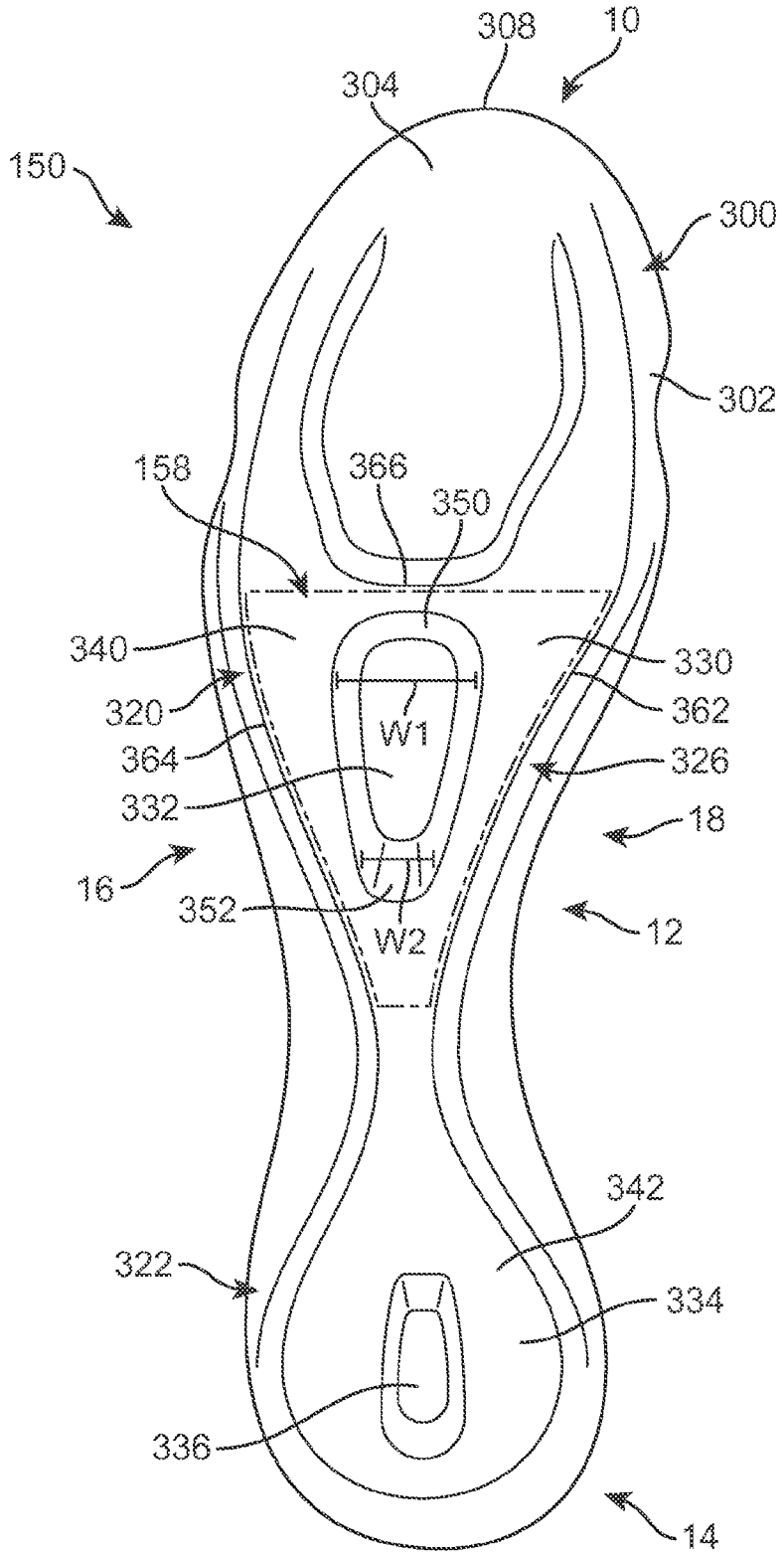
FIG. 4 is a bottom view of an embodiment of a sole structure.
Figure 5:
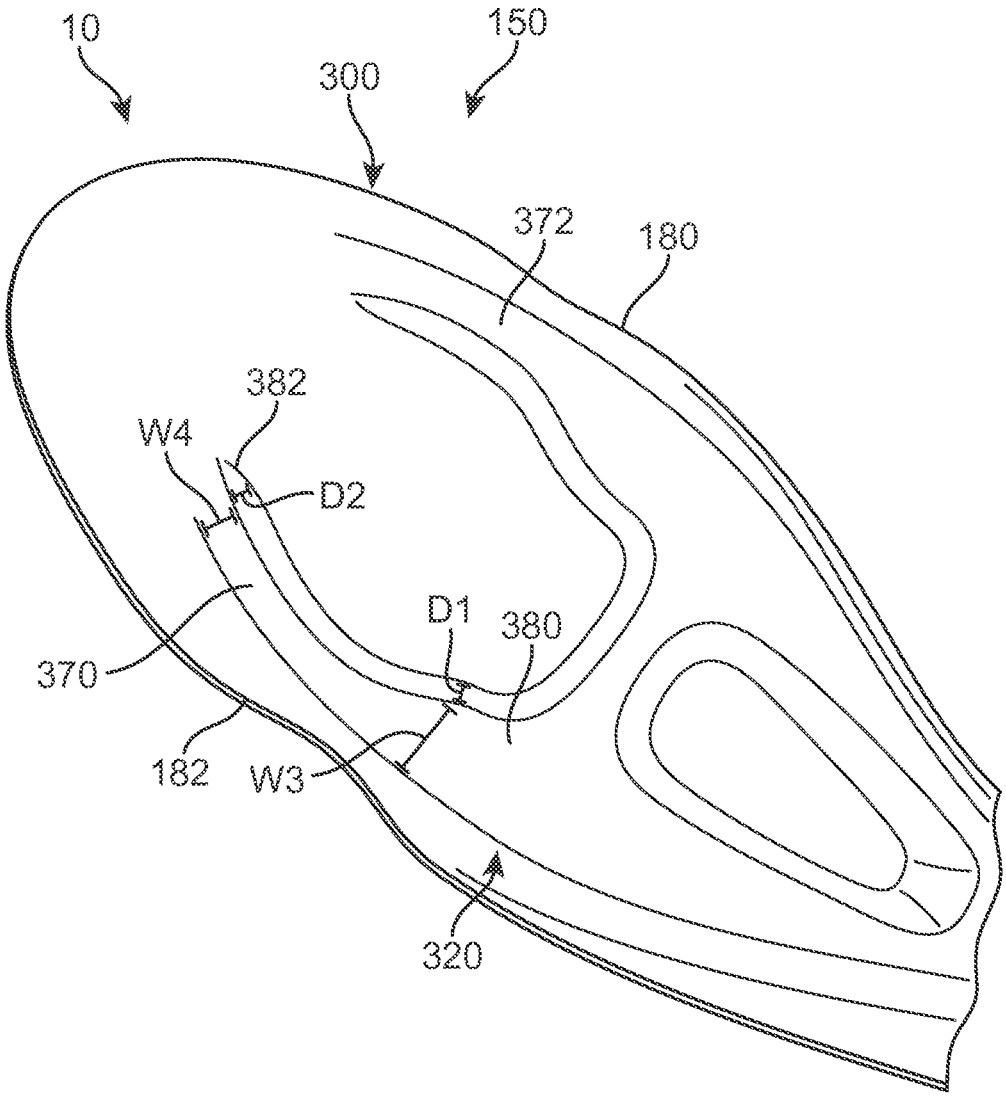
FIG. 5 is an enlarged view of an embodiment of a forefoot portion of a sole structure.

FIGS. 3 through 5 illustrate various views of distal side 158 of sole structure 150. Referring first to FIGS. 3 and 4, sole structure 150 may include base portion 300. Base portion 300 may extend from forefoot portion 10 to heel portion 14 of sole structure 150. In the current embodiment, base portion 300 is comprised of outer peripheral edge 302 and forward portion 304. In some cases, outer peripheral edge 302 may extend around a substantially majority of the periphery of sole structure 150. In addition, in some cases, forward portion 304 comprises a portion of forefoot portion 10 that is disposed adjacent to forefoot peripheral edge 308.

In some embodiments, base portion 300 may be characterized as a portion of sole structure 150 with a relatively low degree of curvature. In some cases, base portion 300 may be characterized as a portion of sole structure over which the depth of sole structure 150 remains substantially shallow. In other cases, however, the depth of base portion 300 could vary in any manner. Also, in other cases, the curvature of base portion 300 could vary in any other manner.

A sole structure can include provisions for distributing forces throughout different portions of the sole structure. In some cases, a sole structure can incorporate one or more portions of increased depth that enhance structural support. In some cases, the portions of increased depth can be shaped to distribute forces applied at a center of a sole structure across the sole structure.

Sole structure 150 may also include one or more bulging portions. The term "bulging portion" as used throughout this detailed description and in the claims refers to any portion of a sole structure that extends outwardly or distally from a base portion. In some cases, the average depth of a bulging portion may be substantially greater than the average depth of a base portion.

In some embodiments, sole structure 150 includes first bulging portion 320 and second bulging portion 322. First bulging portion 320 and second bulging portion 322 may generally extend outwardly from distal side 158 of sole structure 150. In some cases, first bulging portion 320 and second bulging portion 322 may be characterized as raised surfaces or raised plateaus of sole structure 150. Moreover, as shown in FIG. 3, the average depth of first bulging portion 320 and second bulging portion 322 may be substantially greater than the average depth of base portion 300.

In some embodiments, first bulging portion 320 and/or second bulging portion 322 may be integrally formed with base portion 300. In particular, in some cases, first bulging portion 320, second bulging portion 322 and base portion 300 may comprise a single monolithic structure. For example, in some cases, first bulging portion 320, second bulging portion 322 and base portion 300 may be formed from a single material layer or from multiple layers stacked together. In other cases, however, first bulging portion 320 and/or second bulging portion 322 may be separate components from base portion 300.

Generally, first bulging portion 320 and second bulging portion may be disposed in any portion of sole structure 150. In some cases, first bulging portion 320 may generally extend through forefoot portion 10 and midfoot portion 12. In other cases, however, first bulging portion 320 could be disposed in any other portion of sole structure 150. In some cases, second bulging portion 322 may generally extend through heel portion 14. In other cases, however, second bulging portion 322 may extend through any other portion of sole structure 150.

In some cases, first bulging portion 320 and second bulging portion 322 may be substantially continuous with one another. For example, in one embodiment, first bulging portion 320 and second bulging portion 322 may comprise a single elongated bulging portion 326. In other embodiments, however, first bulging portion 320 and second bulging portion 322 may be discontinuous. In other words, in some cases, first bulging portion 320 and second bulging portion 322 could be separated by base portion 300.

In different embodiments, the peripheral shape of a bulging portion can vary. Examples of different peripheral shapes for a bulging portion include, but are not limited to: rounded, circular, elliptical, triangular, square, rectangular, polygonal, regular, irregular, symmetric, asymmetric as well as any other kinds of shapes. In one embodiment, first bulging portion 320 may have an approximately triangular peripheral shape, as seen most clearly in FIG. 4. This triangular shape may be associated with medial edge 362, lateral edge 364 and forward edge 366. In one embodiment, second bulging portion 322 may have an approximately rounded peripheral shape. It will be understood that the peripheral shapes used to describe first bulging portion 320 and second bulging portion 322 are only intended as approximations. For example, first bulging portion 320 may only be approximately triangular and deviations from this approximate shape occur along different portions of the edges of bulging portion 320.

Each bulging portion may further include a peripheral portion and a central portion. In some cases, first bulging portion 320 includes first peripheral portion 330 and first central portion 332. First central portion 332 may be bounded by first peripheral portion 330. In some cases, second bulging portion 322 includes second peripheral portion 334 and second central portion 336. Second central portion 336 may be bounded by second peripheral portion 334.

In some cases, first central portion 332 may be recessed with respect to first peripheral portion 330. In particular, first central portion 332 may be recessed with respect to exterior surface 340 of first peripheral portion 330. Likewise, in some cases, second central portion 336 may be recessed with respect to second peripheral portion 334. In particular, second central portion 336 may be recessed with respect to exterior surface 342 of second peripheral portion 334.

Generally, the shapes of a central portion that is recessed with respect to a peripheral portion may vary. Examples of different shapes for a central portion include, but are not limited to: rounded, circular, elliptical, triangular, square, rectangular, polygonal, regular, irregular, symmetric, asymmetric as well as any other kinds of shapes. Moreover, the shape of a central portion may be selected according to the location along a sole structure.

In some embodiments, first central portion 332 may have a rounded shape. In some cases, first central portion 332 may an elongated rounded shape. In one embodiment, first central portion 332 may have a teardrop-like shape. In particular, the width of first central portion 332 may generally increase towards forefoot portion 10.

Referring to FIG. 4, first central portion 332 may include first end portion 350 and second end portion 352. First end portion 350 may be disposed forwardly of second end portion 352. In the current embodiment, first end portion 350 may have width W1. Additionally, second end portion 352 may have width W2. In some cases, width W1 may be substantially greater than width W2. Moreover, the width of first central portion 332 gradually decreases between width W1 at first end portion 350 and width W2 at second end portion 352.

Although the current embodiment illustrates a central portion with an increasing width towards forefoot portion 10, other embodiments could include a central portion whose width changes in any other manner. As an example, in another embodiment, the width of a central portion could generally increase towards heel portion 14. In still another embodiment, the width of a central portion could remain approximately constant.

In some embodiments, second central portion 336 may have a rounded shape. In some cases, second central portion 336 may an elongated rounded shape. In one embodiment, second central portion 336 may have a teardrop-like shape. In particular, the width of first central portion 332 may generally increase towards heel portion 14. In other cases, however, the approximate shape of second central portion 336 could vary in any other manner.

A sole structure can include provisions to improve stability in a forefoot portion. In some cases, a sole structure can include bulging portions that taper in size through a forefoot portion. In some cases, the bulging portions may extend along the periphery of the forefoot portion.

Referring now to FIG. 5, first bulging portion 320 may further include one or more tapered portions. In one embodiment, first bulging portion 320 includes first tapered portion 370 and second tapered portion 372. First tapered portion 370 may extend along forefoot lateral edge 182 of sole structure 150. Second tapered portion 372 may extend along forefoot medial edge 180 of sole structure 150.

First tapered portion 370 and second tapered portion 372 form filament like extensions of first bulging portion 320 that taper in width and depth. For purposes of illustration, the depth of first tapered portion 370 and/or second tapered portion 372 may be measured relative to base portion 300. First tapered portion 370 may include first end portion 380 and second end portion 382. First end portion 380 may have width W3 and depth D1. Second end portion 382 may have width W4 and depth D2. In some cases, width W4 is substantially less than width W3. Also, in some cases, depth D2 is substantially less than depth D1. Moreover, the width of first tapered portion 370 may gradually decrease from first end portion 380 to second end portion 382. Similarly, in some cases, the depth of first tapered portion 370 may gradually decrease from first end portion 380 to second end portion 382.

As illustrated in FIG. 5, the width and depth of first tapered portion 370 gradually decrease until they are approximately zero. In other words, first tapered portion 370 gradually transitions to base portion 300 without any sudden changes in width or depth. In some cases, the width and depth of second tapered portion 372 may also gradually decrease in a similar manner. This tapered configuration may help improve the stability of forefoot portion by removing any forward edges of first bulging portion 320 at the forward most end of forefoot portion 10.

Figure 6:
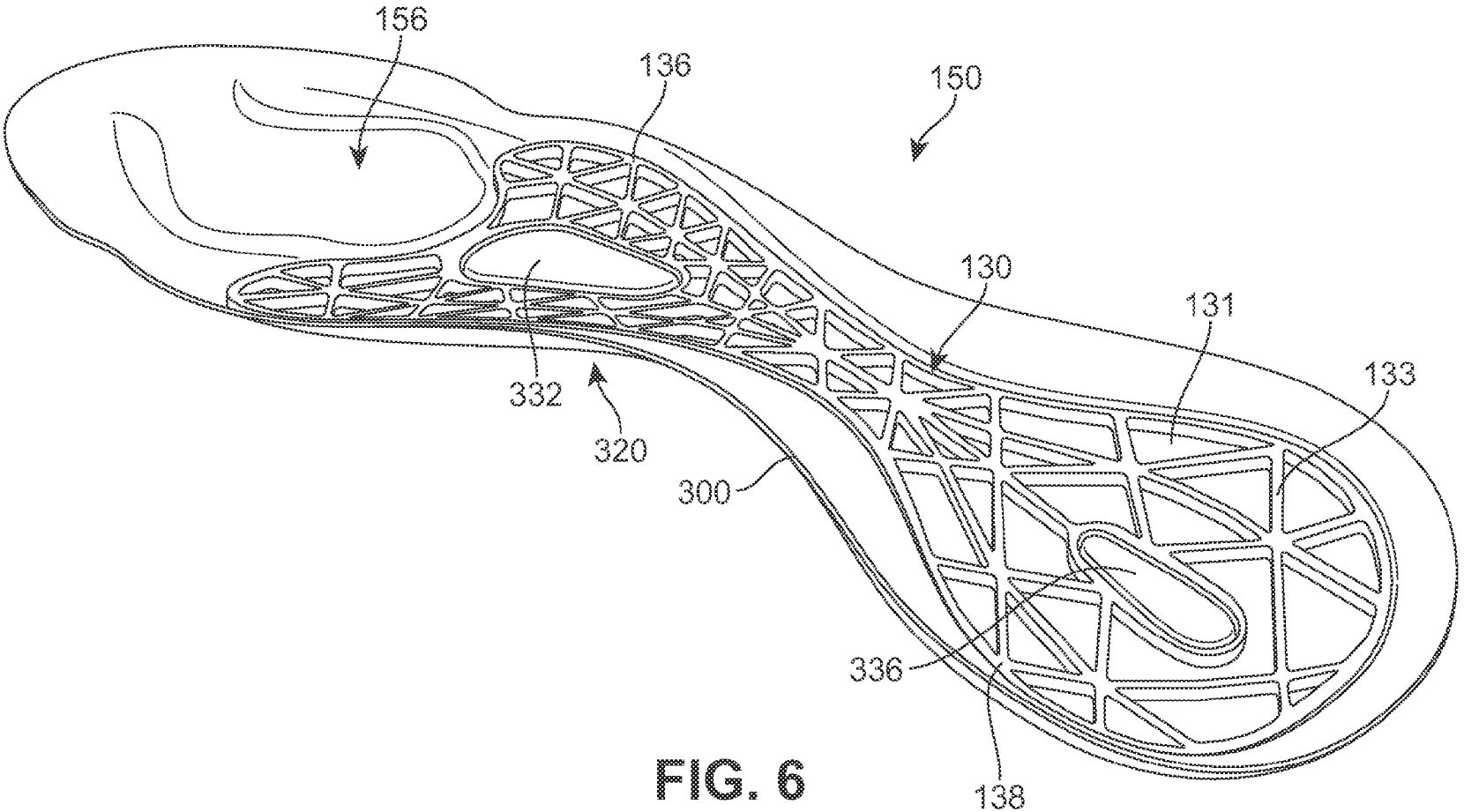
FIG. 6 is an isometric view of an embodiment of a proximal side of a sole structure.
Figure 7:
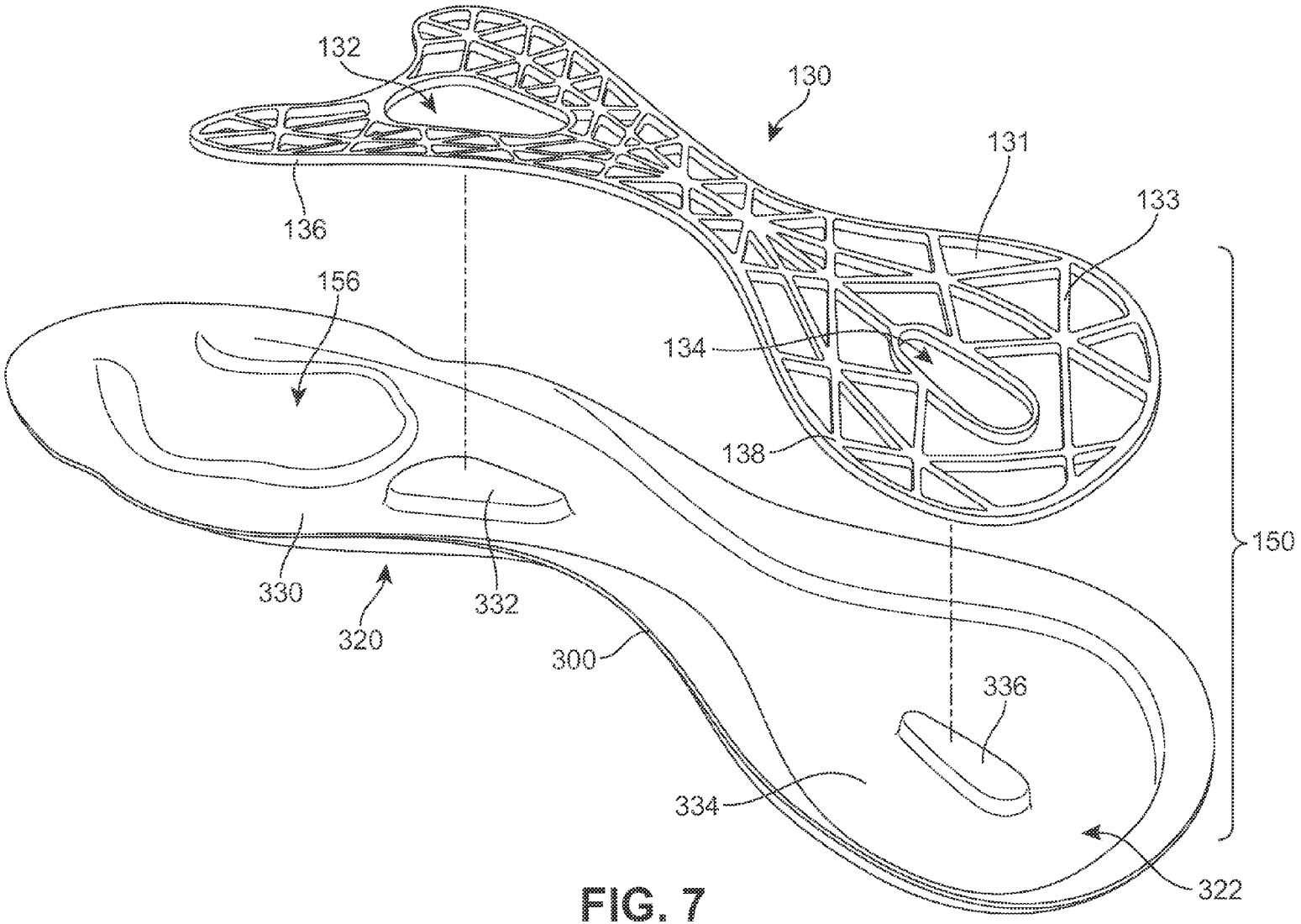
FIG. 7 is an isometric exploded view of an embodiment of a proximal side of a sole structure.

FIGS. 6 and 7 illustrate isometric assembled and isometric exploded views, respectively, of proximal side 156 of sole structure 150. Referring to FIGS. 6 and 7, first peripheral portion 330 and second peripheral portion 334 may be recessed with respect to base portion 300 on proximal side 156. Also, first central portion 332 and second central portion 336 may be raised with respect to first peripheral portion 330 and second peripheral portion 334 on proximal side 156.

A sole member can include provisions for reinforcing one or more bulging portions of a sole structure. In some cases, a sole member can include a reinforcing member that reinforces one or more bulging portions. In some cases, a reinforcing member may be disposed within one or more bulging portions.

As previously discussed, sole structure 150 may be associated with reinforcing member 130. In some embodiments, reinforcing member 130 may comprise a base layer 131. In some cases, base layer 131 may be a relatively thin layer that is reinforced with rib portions 133. In particular, rib portions 133 may be arranged in a web-like manner along base layer 131.

In different embodiments, the configuration of rib portions 133 could vary. In some cases, rib portions 133 may be configured in various different shapes including, but not limited to: rounded shapes, triangular shapes, rectangular shapes, hexagonal shapes, polygonal shapes, regular shapes, irregular shapes as well as any other kinds of shapes. Moreover, the pattern of shapes could be regular, irregular, tessellated as well as any other kind of pattern. In one embodiment, rib portions 133 are arranged to form a tessellated triangle pattern. This configuration may provide enhanced strength for reinforcing member 130 while reducing the overall weight and/or density of reinforcing member 130.

In some embodiments, reinforcing member 130 may be configured to enhance the strength of sole structure 150 and reduce unwanted bending. In some cases, reinforcing member 130 may be disposed against sole structure 150. More specifically, in some cases, reinforcing member 130 may be configured to associate with one or more bulging portions of sole structure 150.

Generally, the material properties of reinforcing member 130 may vary in different embodiments. In some cases, reinforcing member 130 may be substantially less rigid than sole structure 150. In other cases, reinforcing member 130 may have a rigidity that is substantially similar to the rigidity of sole structure 150. In still other cases, reinforcing member 130 could be substantially more rigid than sole structure 150. Moreover, in some cases, the rigidity of reinforcing member 130 may vary according to the materials used as well as the configuration of rib portions 133.

In some cases, reinforcing member 130 is configured to fit within first bulging portion 320 and second bulging portion 322 on proximal side 156. Specifically, first portion 136 of reinforcing member 130 may fit within the cavity formed by first peripheral portion 330 on proximal side 156. Likewise, second portion 138 of reinforcing member 130 may fit within the cavity formed by second peripheral portion 334 on proximal side 156.

A reinforcing member can include provisions for associating with raised central portions on a proximal side of a sole structure. In some embodiments, reinforcing member 130 includes first cut-out portion 132 and second cut-out portion 134 (see FIG. 7). In some cases, the shapes of first cut-out portion 132 and second cut-out portion 134 may correspond to the shapes of first central portion 332 and second central portion 336, respectively. In some cases, first central portion 332 may be inserted through first cut-out portion 132. In some cases, second central portion 334 may be inserted through second cut-out portion 134. This arrangement allows reinforcing member 130 to reinforce first bulging portion 320 and second bulging portion 322 while remaining approximately flush with base portion 300 on proximal side 156.

Figure 8:
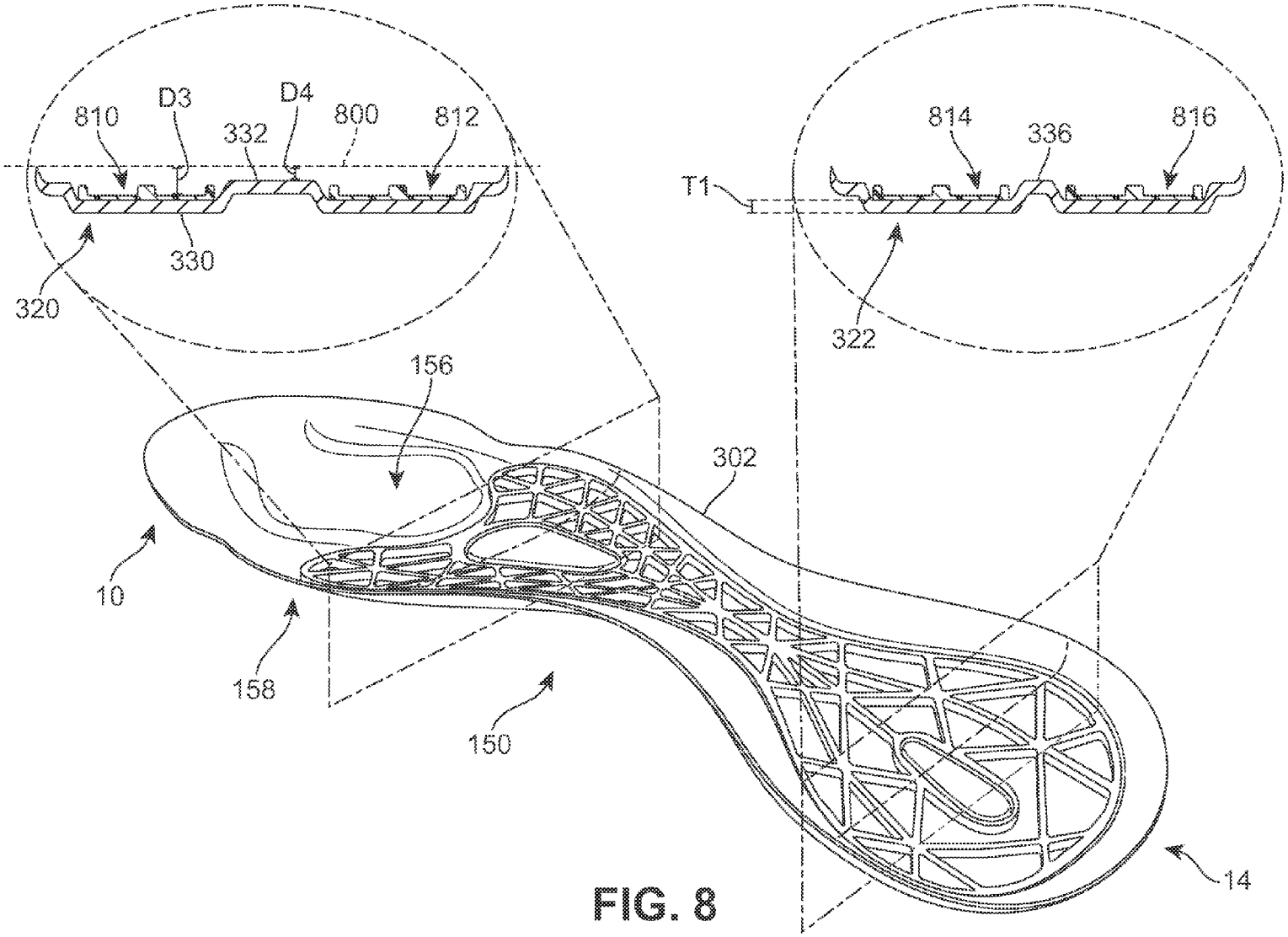
FIG. 8 is an isometric view of an embodiment of a proximal side of a sole structure including enlarged cross sectional views of a forefoot portion and a heel portion of the sole structure.

FIG. 8 illustrates several cross sectional views of an embodiment of sole structure 150. Referring to FIG. 8, first bulging portion 320 has a convex shape with respect to distal side 158 of sole structure 150. For purposes of illustrating the approximate depth of various portions of sole structure 150, reference is made to planar surface 800. Planar surface 800 is a surface that is approximately coincident with outer peripheral edge 302 of sole structure 150.

In this case, first peripheral portion 330 of first bulging portion 320 has a depth D3 with respect to planar surface 800. Additionally, first central portion 332 of first bulging portion 320 has a depth D4 with respect to planar surface 800. In some cases, depth D4 is substantially less than depth D3. In a similar manner, second peripheral portion 334 of second bulging portion 322 may have a greater depth than second central portion 336. In a similar manner, the depth of second peripheral portion 334 may be substantially greater than the depth of second central portion 336.

This difference in depth between the peripheral portion and central portion of each bulging portion may provide cross-sectional channels. In some cases, first bulging portion 320 and second bulging portion 322 provide channel like structures that extend from forefoot portion 10 to heel portion 14. For example, first bulging portion 320 may provide first channel portion 810 and second channel portion 812, which are separated by first central portion 332. Likewise, second bulging portion 322 may provide third channel portion 814 and fourth channel portion 816, which are separated by second central portion 336. These channels may increase the stiffness of sole structure 150 in the regions spanned by first bulging portion 320 and second bulging portion 322. Moreover, reinforcing portion 130 may act to enhance the structural integrity of first bulging portion 320 and second bulging portion 322. This arrangement may further facilitate the distribution of forces from first central portion 332 and second central portion 336 throughout forefoot portion 10 and heel portion 14, respectively.

Generally, the thickness of sole structure 150 may vary. The term "thickness" as used throughout this detailed description and in the claims refers to a measurement of the distance between proximal side 156 and distal side 158 at any particular location along sole structure 150. In some embodiments, for example, the thickness of any portion of sole structure 150 may be approximately constant over the entirety of sole structure 150. For example, in the current embodiment, sole structure 150 has an approximately constant thickness T1. In other cases, however, the thickness of sole structure 150 could vary over different portions.

Figure 9:
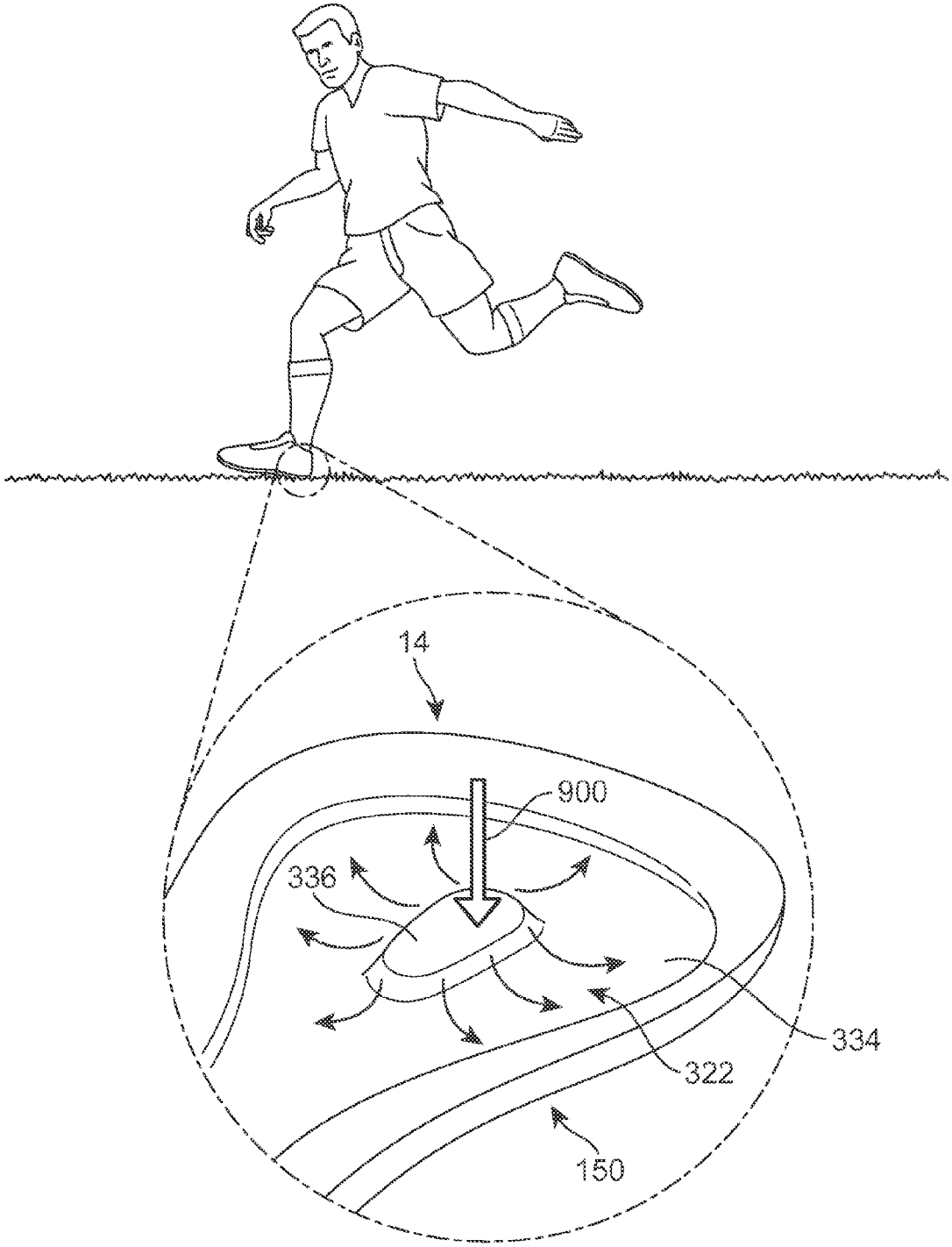
FIG. 9 is a schematic view of the distribution of forces throughout a heel portion of a sole structure during contact with a ground surface according to one embodiment.
Figure 10:
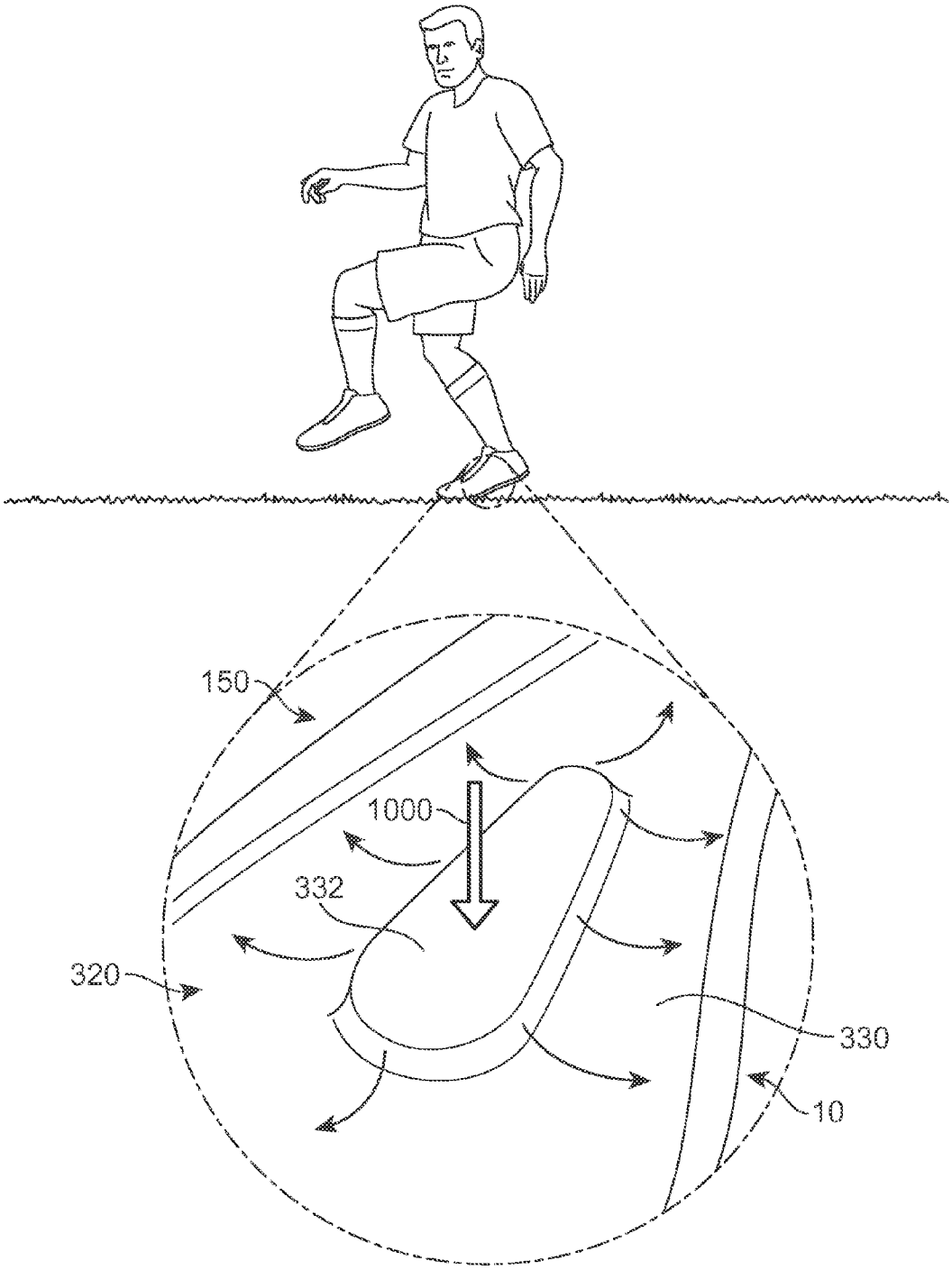
FIG. 10 is a schematic view of the distribution of forces throughout a forefoot portion of a sole structure during contact with a ground surface according to one embodiment.

FIGS. 9 and 10 illustrate schematic views of force distribution through sole structure 150 during a heel strike and forefoot strike, respectively, according to one embodiment. For purposes of illustration, sole structure 150 is shown in isolation, though it will be understood that reinforcing member 130 and outer member 120 may also be present in some embodiments. Referring first to FIG. 9, as the heel of a user makes contact with a ground surface during a heel strike, force 900 may be initially applied at second central portion 336. Due to the contoured shape of second bulging portion 322, force 900 may be distributed through second peripheral portion 334. This configuration helps to more evenly distribute forces that are applied to heel portion 14 during a heel strike.

Referring now to FIG. 10, as the forefoot of the user contacts the ground following the heel strike, force 1000 may be applied at first central portion 332. Due to the contoured shape of first bulging portion 320, force 1000 may be distributed through first peripheral portion 330. This configuration helps to more evenly distribute forces that are applied to forefoot portion 10.

A sole structure can include provisions for enhancing cross sectional strength. In some cases, the orientation of components of a composite layer may be selected to control the rigidity or other structural properties of the sole structure. In some cases, the orientation of a woven composite material can be selected to control the rigidity or other structural properties of the sole structure.

Figure 11:
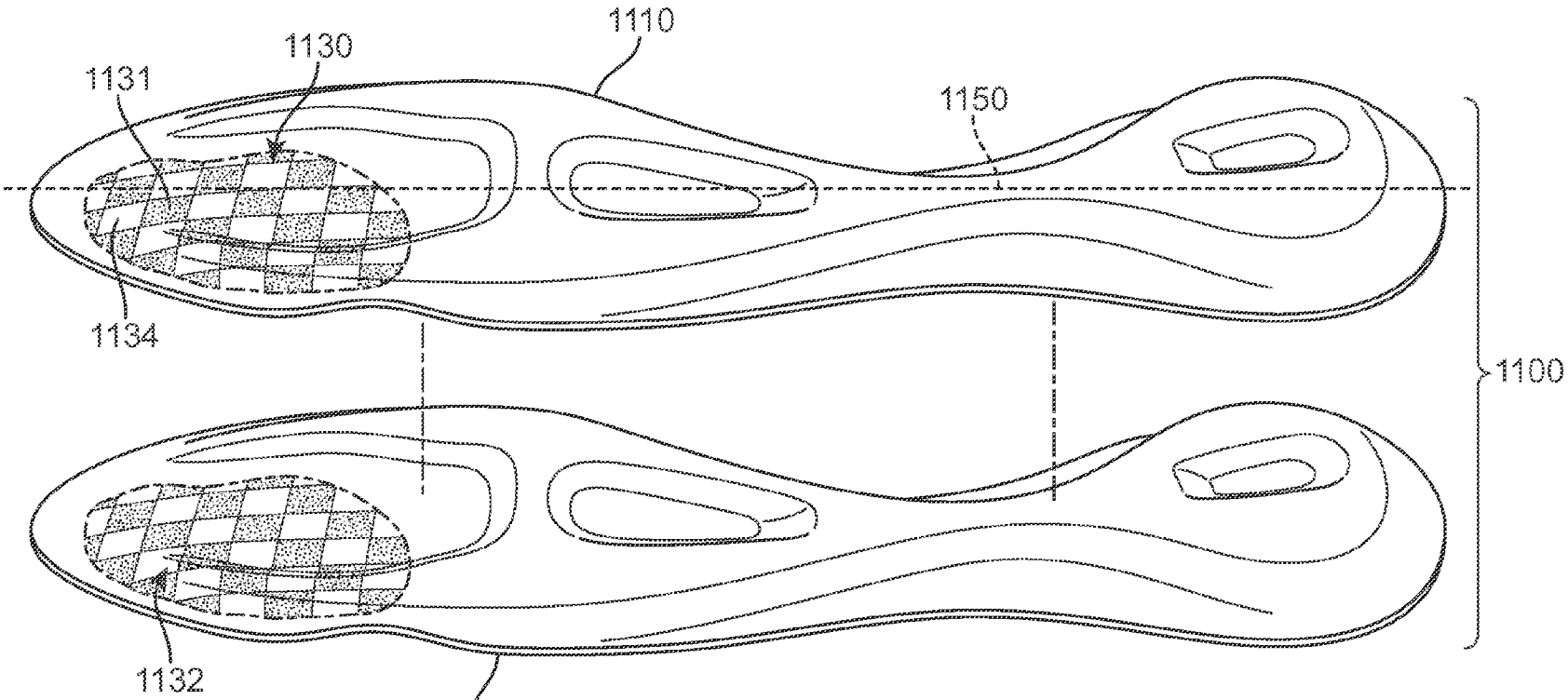
FIG. 11 is an exploded isometric view of an embodiment of a sole structure comprising two layers of woven composite material.
Figure 12:
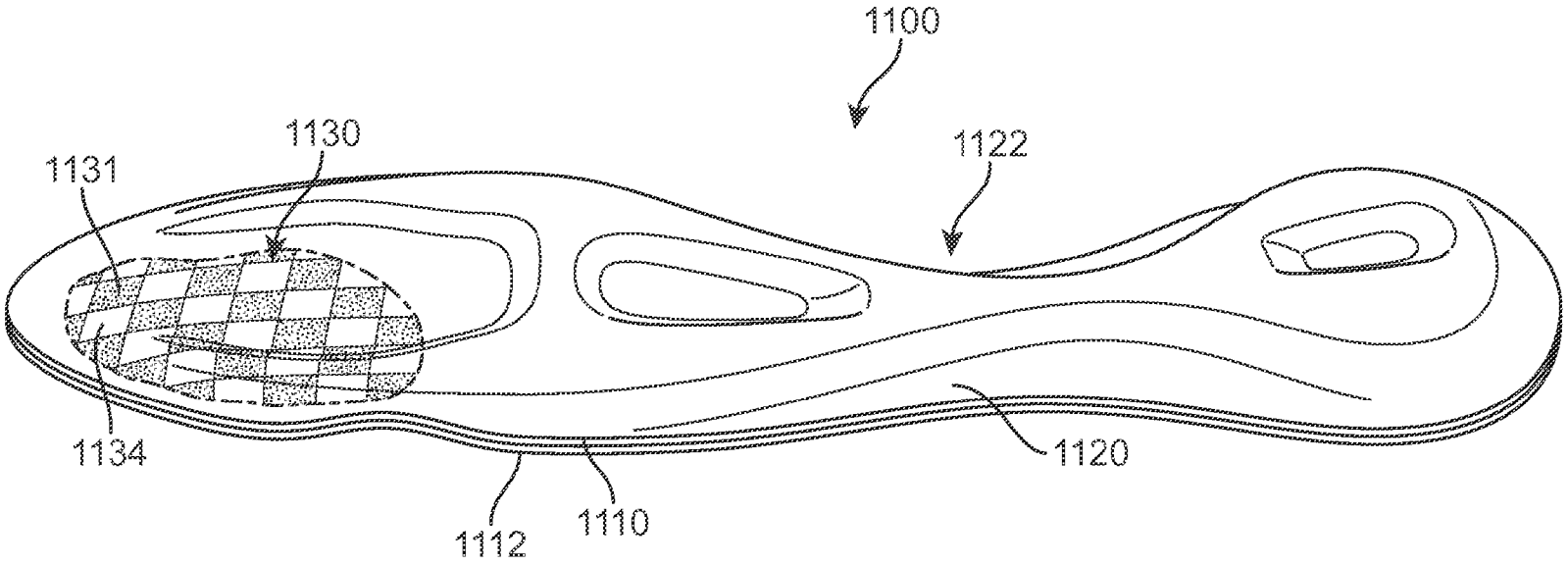
FIG. 12 is an isometric view of an embodiment of a sole structure comprising two layers of a woven composite material.

FIGS. 11 and 12 illustrate a view of an embodiment of sole structure 1100. Sole structure 1100 may be substantially similar to sole structure 150. In particular, sole structure 1100 may comprise first layer 1110 and second layer 1112. Each layer may comprise a substantially similar geometry to the geometry of sole structure 150. When assembled, sole structure 1100 may comprise base portion 1120 and elongated bulging portion 1122 (see FIG. 12).

As discussed above, in some embodiments, layers of a sole structure can be made of composite materials. In some cases a sole structure can be made of a carbon fiber reinforced composite material. In some cases, a sole structure can comprise multiple layers of a carbon fiber composite material. In one embodiment, first layer 1110 and second layer 1112 are both made of a carbon fiber composite material.

Each layer may comprise a woven composite structure. For example, first layer 1110 may comprise filaments 1130 that are woven together in a plain weave pattern. For purposes of illustration, the weaving pattern formed by filaments 1130 is only shown at one portion of first layer 1110. However, it will be understood that the entirety of first layer 1110 may comprise a woven composite. In a similar manner, second layer 1112 may comprise filaments 1132 that are woven together in a substantially similar plain weave pattern.

The woven structure of a composite material can be characterized by the weave orientation. The term "weave orientation" refers to the orientation or direction of a set of filaments within a weave. In some cases, the weave orientation can be given as the angle between a central axis of a structure and a filament intersecting the central axis. As one example, in a situation where one set of filaments of a weave may be approximately parallel with a central axis, the weave orientation may be approximately 0 degrees. As another example, in a situation where one set of filaments makes an angle of approximately 30 degrees with the central axis, the weave orientation may be approximately 30 degrees.

In the current embodiment, shown in FIGS. 11 and 12, filaments 1130 comprise a first set of filaments 1131 (indicated with shading) and a second set of filaments 1134. First set of filaments 1131 are woven in a substantially perpendicular fashion with second set of filaments 1134. In this case, first set of filaments 1131 are generally oriented along the longitudinal direction of sole structure 1100. Also, second set of filaments are 1134 generally oriented along the lateral direction of sole structure 1100. In addition, first set of filaments 1131 are seen to be approximately parallel with central axis 1150 of sole structure 1100. Therefore, in this case, the weave orientation of first layer 1110 is seen to be approximately 0 degrees. Moreover, second layer 1112, which is shown with a substantially identical weave pattern and orientation, also has a weave orientation of approximately 0 degrees.

Figure 13:
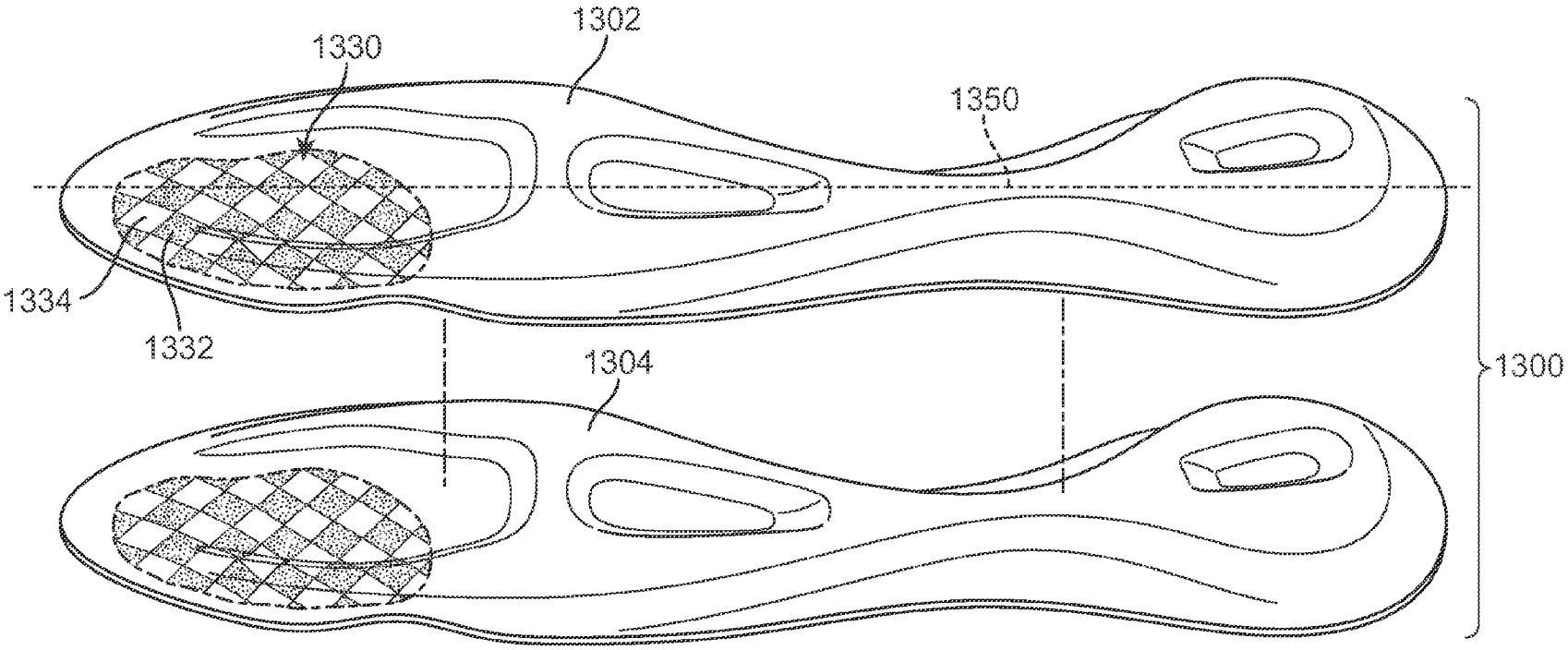
FIG. 13 is an exploded isometric view of an alternative embodiment of a sole structure comprising two layers of a woven composite material.

FIG. 13 illustrates another possible embodiment of a sole structure 1300, which has a different weave orientation from the one shown in FIGS. 11 and 12. As seen in FIG. 13, filaments 1330 of first layer 1302 comprise a first set of filaments 1332 (indicated with shading) and a second set of filaments 1334. First set of filaments 1332 intersect central axis 1350 of sole structure 1300 at an angle of approximately 45 degrees. Moreover, second layer 1304, which is shown with a substantially identical weave pattern and orientation, also has a weave orientation of approximately 45 degrees.

Although the current embodiments illustrate configurations in which adjacent layers of a sole structure have substantially identical weave orientations, in still other embodiments the weave orientations of adjacent layers could be different. For example, in another embodiment, one layer of a sole structure could have a weave orientation of approximately 0 degrees while a second layer could have a weave orientation of approximately 45 degrees. Moreover, it will be understood that the weave orientation can have any possible angular value and is not limited to values of 0 or 45 degrees. In other cases, the weave orientation could have any value in the range between 0 and 90 degrees. In still other cases, the weave orientation could have any value in the range between 0 and 360 degrees.

The configuration described above helps to improve the strength of a sole member while helping to minimize weight. In particular, selecting various different weave orientations for each layer of the sole structure helps provide stable configurations that are stiff enough to support a foot during walking, running, cutting as well as other ambulatory activities. Moreover, when these woven configurations are used in combination with the geometric features described above, the overall stiffness of the sole structure can be tuned to meet the needs of a user. In some cases, this arrangement allows the number of layers required to form a sole structure to be reduced over systems that do not have these particular weave orientations and geometric features.

Figure 14:
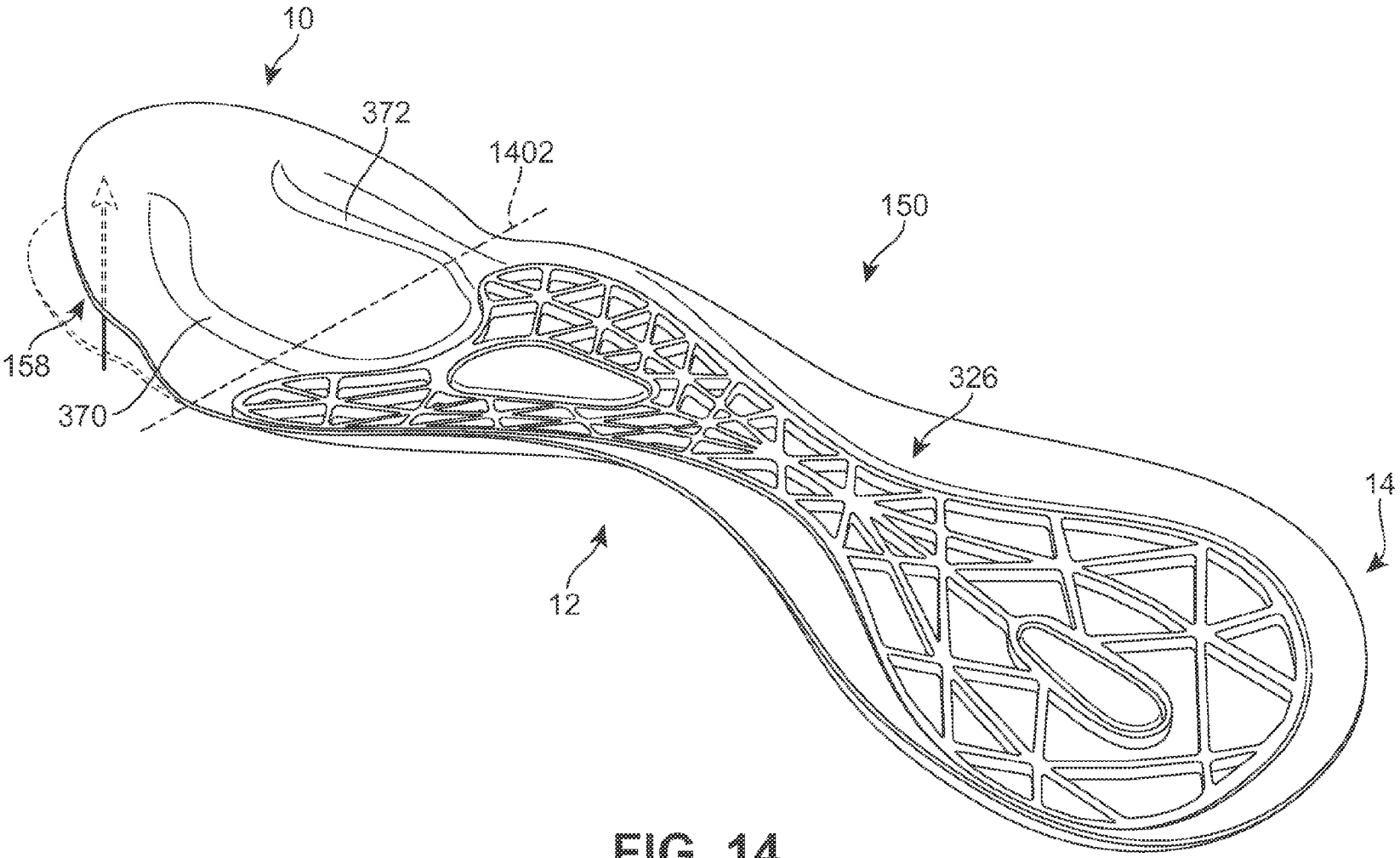
FIG. 14 is a schematic view of an embodiment of a sole structure bending under an applied force.
Figure 15:
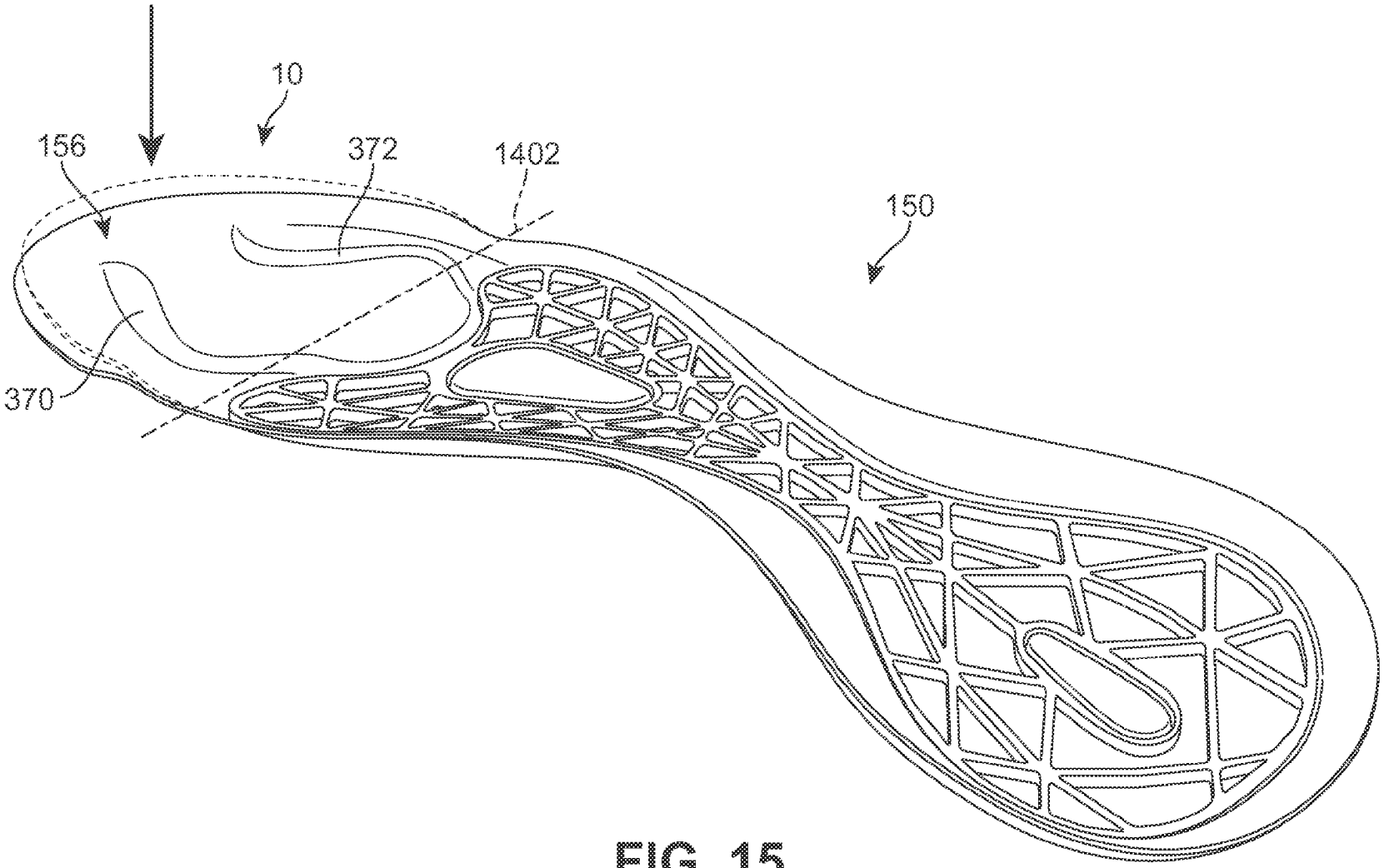
FIG. 15 is a schematic view of an embodiment of a sole structure resisting bending under an applied force.

FIGS. 14 and 15 illustrate schematic views of sole structure 150 responding to various applied forces. As seen in FIG. 14, a force is applied at distal side 158 of forefoot portion 10. This force may represent, for example, the force applied by a ground surface as the forefoot is planted. Under this upwardly directed force, sole structure 150 may provide some bending, especially along bending axis 1402.

Generally, bending axis 1402 could be associated with any portion of sole structure 150. In some cases, bending axis 1402 may coincide approximately with the location of the ball of the foot. However, in other cases, bending axis 1402 could be disposed in any other portion of sole structure 150. The location and orientation of bending axis 1402 may generally be controlled by the geometry of sole structure 150 as well as the shape and location of reinforcing member 130.

The bending illustrated in FIG. 14 may occur because of the combination of weave orientation and geometry discussed above for sole structure 150. Specifically, elongated bulging portion 326 increases the cross sectional strength of midfoot portion 12 and heel portion 14, which increases stiffness and reduces bending in these areas. However, the tapered geometry of first tapered portion 370 and second tapered portion 372 may allow for some amount of bending along bending axis 1402.

Referring now to FIG. 15, a force is applied to proximal side 156 of forefoot portion 10. Under this downward force, sole structure 150 may tend to resist bending. The geometry of first tapered portion 370 and second tapered portion 372 may help resist bending in this downward direction, especially along bending axis 1402. As seen in FIGS. 14 and 15, under this downward force, the displacement of forefoot portion 10 is substantially less than the displacement of forefoot portion 10 when an upwardly directed force is applied.

This configuration helps provide unidirectional bending for sole structure 150, especially in forefoot portion 10. This may help provide some energy return for a user during motions including walking, running, cutting and other ambulatory activities where an upward force us applied to forefoot portion 10 by a ground surface. Furthermore, this arrangement helps to resist downward bending of forefoot portion 10, which may help provide better support during kicks or other activities where a downward force is applied to forefoot portion 10.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole member for an article of footwear, comprising:
a sole structure and a reinforcing member;
the sole structure including:
a base portion, the base portion including a first side and a second side;
a first bulging portion comprising a first peripheral portion and a first central portion, the first central portion being bounded by the first peripheral portion;
the first central portion extending proximally from the second side of the base portion;
the first central portion being raised with respect to the first peripheral portion on the second side of the base portion;
a second bulging portion comprising a second peripheral portion and a second central portion, the second central portion being bounded by the second peripheral portion;
the second central portion extending proximally from the second side of the base portion;
the second central portion being raised with respect to the second peripheral portion on the second side of the base portion;
the reinforcing member disposed against the second side of the base portion in a region corresponding to both the first bulging portion and the second bulging portion; and
wherein the reinforcing member includes a first cut-out portion that is sized and dimensioned to receive the first central portion of the first bulging portion.

2. The sole member according to claim 1, wherein the reinforcing member comprises a base layer and rib portions.

3. The sole member according to claim 2, wherein the rib portions are arranged in a tessellated pattern.

4. The sole member according to claim 3, wherein the sole member further comprises an outer member that covers a portion of the sole structure.

5. The sole member according to claim 1, wherein the reinforcing member is substantially rigid.

6. The sole member according to claim 5, wherein the sole structure is substantially more rigid than the reinforcing member.

7. The sole member according to claim 1, wherein the reinforcing member is configured to lie approximately flush against the base portion when the first cut-out portion receives the first central portion.

8. The sole member according to claim 1, wherein the first side is a distal side, wherein the second side is a proximal side, and wherein the reinforcing member is configured to fit within a cavity formed by the first peripheral portion and the second peripheral portion on the second side of the base portion.

9. A sole member for an article of footwear, comprising:
a sole structure and a reinforcing member;

the sole structure including:

a base portion comprising a first peripheral portion and a first central portion;

the first central portion being raised with respect to the first peripheral portion on a proximal side of the base portion;

the first peripheral portion comprising a cavity along the proximal side of the base portion;

the reinforcing member disposed against the proximal side of the base portion in a region corresponding to the cavity of the first peripheral portion;

wherein the reinforcing member includes a first cut-out portion that is configured to receive the first central portion of the base portion; and wherein a first top surface of the reinforcing member is substantially flush with a second top surface of the first central portion.

10. The sole structure according to claim 9, wherein the base portion further comprises a second peripheral portion and a second central portion that are both disposed in a heel portion of the sole structure.

11. The sole structure according to claim 10, wherein the second central portion has a second height, wherein the reinforcing member has a first thickness, and wherein the second height and the first thickness are substantially similar.

12. The sole structure according to claim 9, wherein the cavity has a first depth, wherein the reinforcing member has a first thickness, and wherein the first depth and the first thickness are substantially similar.

13. The sole structure according to claim 9, wherein the first central portion has a first height, wherein the reinforcing member has a first thickness, and wherein the first height and the first thickness are substantially similar.

14. A sole member for an article of footwear, comprising:

a forefoot portion, a midfoot portion, and a heel portion;

a sole structure and a reinforcing member;

the sole structure including:

a base portion, the base portion including a distal side and a proximal side;

a first bulging portion that extends distally from the distal side of the base portion, the first bulging portion further comprising at least one tapering portion extending along an outer peripheral edge of the base portion;

the at least one tapering portion including a first end portion in the midfoot portion and a second end portion in the forefoot portion;

wherein the depth of the at least one tapering portion decreases from the first end portion to the second end portion until the depth of the at least one tapering portion is approximately zero;

the first bulging portion comprising a cavity along the proximal side of the base portion, the cavity extending through the midfoot portion and the heel portion of the base portion, wherein the cavity is configured to receive the reinforcing member;

the reinforcing member being disposed in the cavity against the proximal side of the base portion;

the sole member further including a bending axis associated with the at least one tapering portion, the bending axis being configured to facilitate bending of the forefoot portion relative to the midfoot portion; and wherein the reinforcing member is spaced from the bending axis.

15. The sole structure according to claim 14, wherein the bending axis is configured to permit bending of the forefoot portion of the sole member in an upward direction and resist bending of the forefoot portion of the sole member in a downward direction.

16. The sole structure according to claim 14, wherein the sole structure is made of a material that includes carbon fiber.

17. The sole structure according to claim 14, wherein the base portion further includes at least a first central portion, the first central portion extending upward from the proximal side of the base portion, and wherein the reinforcing member includes a first cut-out portion that is configured to receive the first central portion.

18. The sole member according to claim 1, wherein the reinforcing member further includes a second cut-out portion that is sized and dimensioned to receive the second central portion of the second bulging portion.

19. The sole member according to claim 18, wherein the first central portion is disposed in a midfoot portion of the sole structure and the second central portion is disposed in a heel portion of the sole structure.

20. The sole member according to claim 1, wherein a first proximal surface of the first central portion is substantially flush with a second proximal surface of the reinforcing member.

* * * * *